US005866534A

United States Patent [19]

Gryj et al.

[11] Patent Number: 5,866,534

[45] Date of Patent: Feb. 2, 1999

[54] STABLE LIQUID CLEANERS CONTAINING PINE OIL

[75] Inventors: Abraham Cazes Gryj; Juan Aguilar Pachecano, both of Mexico, Mexico; Thomas Francis Connors, Piscataway; David Frank Suriano, Monroe, both of N.J.

[73] Assignee: Colgate-Palmolive Co., New York, N.Y.

[21] Appl. No.: 655,510

[22] Filed: May 30, 1996

Related U.S. Application Data

[60] Provisional application No. 60/000,167 Jun. 12, 1995.

[51] Int. Cl. [6] ..... C11D 3/22; C11D 3/18

[52] U.S. Cl. ..... 510/536; 510/383; 510/501; 510/424; 510/407

[58] Field of Search ..... 514/613; 510/536, 510/407, 383, 501, 424

[56] References Cited

U.S. PATENT DOCUMENTS

| | | | |
|---|---|---|---|
| 4,414,128 | 11/1983 | Goffinet | 251/111 |
| 4,804,683 | 2/1989 | Steltenkamp | 514/529 |
| 5,308,531 | 5/1994 | Urfer et al. | 252/174 |

*Primary Examiner*—John M. Ford
*Attorney, Agent, or Firm*—Bernard Lieberman

[57] ABSTRACT

In accordance with the present invention, a stable aqueous detergent composition is provided which comprises a homogeneous mixture of:

a) pine oil;

b) surfactant;

c) at least one aliphatic alcohol containing 1 to 5 carbon atoms;

d) at least one water soluble glycol mono $C_{1-4}$ alkyl ether solvent having a solubility in water at 25° C. in excess of 10 g/100 g. water; and e) water;

the relative proportions of said alcohol and said glycol being in the weight ratio of about 1:2 to 2:1 and the combined amount of said alcohol and said glycol present in said composition being in the range of from about 1 to less than about 7 wt. %.

In the more preferred embodiment of the invention, the composition further contains an insect repelling amount of at least one insect repellent selected from the group consisting of alkyl or alkaryl amides having from about 5 to 16 carbon atoms.

The compositions of the invention provide clear, stable pine oil dispersions at pine oil concentrations of up to about 25 wt. % which do not separate or cloud up after periods of storage and which have a very low content of volatile organic compounds.

2 Claims, No Drawings

STABLE LIQUID CLEANERS CONTAINING PINE OIL

This application claims the benefit of U.S. Provisional Application Ser. No. 60,000,167 filing date Jun. 12, 1995.

BACKGROUND OF THE INVENTION

1. Field of the Invention.

The invention relates to aqueous-based, liquid all purpose cleaners containing pine oil.

2. Description of Related Art.

Pine oil is a terpene rich oil derived from the extraction or distillation of pine wood, pine needles and/or pine cones. It is essentially the fraction between true turpentine and pine resin and is found to consist of a terpene rich oil containing a complex mixture comprising primarily terpinol, borneol, fenchyl alcohol, terpenes and other terpinols. It is desirably used in aqueous based detergent cleaners because of its pleasant odor which lingers after use and because it imparts a shine to hard surfaces after cleaning. It also exhibits a disinfectant property, particularly when used at more concentrated levels above about 10 wt. %.

Since pine oil and other terpene alcohol-based materials are poorly soluble or insoluble in water, it has been proposed in the prior art to include various polar solvents in water-based formulations to apparently enhance the miscibility of the pine oil in water, and thus enhance the stability of the composition. For example, U.S. Pat. No. 4,414,128 teaches the use of a polar solvent which is partially water soluble (up to 10% by weight-g./100 g. solution) and which contains at least one hydrophilic group such as an aromatic alcohol, ethoxylated phenol, esters of lower alcohols and lower acids and the like, alone or in combination with a non-aqueous solvent which is more highly miscible with water such as a lower alcohol or a monoalkyl ether of ethylene, propylene, diethylene or dipropylene glycol.

In addition, non-aqueous based clear liquid cleaning compositions containing pine oil or terpenes are disclosed in U.S. Pat. No. 5,308,531 which are said to remain clear liquids after dilution with water. This reference teaches that certain alkyl polyglycosides in combination with a dicarboxylic acid can be utilized as a solvent for the pine oil instead of more conventional solvents such as isopropyl alcohol or glycol ethers.

Aqueous-based pine oil cleaning formulations are specifically useful for cleaning wooden, plastic or metal household surfaces such as cabinets, floors, walls and appliances, and therefore advantageously may contain an alkyl or alkaryl amide repellent for repelling insects such as cockroaches. Suitable alkaryl amides include N,N-dialkyl toluamides such as N,N-diethyl-m-toluamide (DEET) and suitable alkamides include neoalkanamides such as methyl neodecanamide (MNDA) or methyl neotridecanamide (MNTDA). For example, U.S. Pat. No. 4,804,683 discloses in Example 8 a liquid pine oil cleaner composition containing a mixture of surfactant, isopropanol, pine oil, MNTDA, sodium sulfate and water.

However, the presence of insect repellents in such formulations containing pine oil presents additional problems with respect to the preparation of clear, isotropic aqueous dispersions which remain stable on standing, i.e., will not cloud up or separate after a period of storage.

SUMMARY OF THE INVENTION

In accordance with the present invention, a stable aqueous detergent composition is provided which comprises a homogeneous mixture of:

a) pine oil;

b) surfactant;

c) at least one aliphatic alcohol containing 1 to 5 carbon atoms;

d) at least one water soluble glycol mono $C_{1-4}$ alkyl ether solvent having a solubility in water at 25° C. in excess of 10 g/100 g. water; and e) water; the relative proportions of said alcohol and said glycol being in the weight ratio of about 1:2 to 2:1 and the combined amount of said alcohol and said glycol present in said composition being in the range of from about 1 to less than about 7 wt. %.

In the more preferred embodiment of the invention, the composition further contains an insect repelling amount of at least one insect repellent selected from the group consisting of alkyl or alkaryl amides having from about 5 to 16 carbon atoms.

The compositions of the invention provide clear, stable pine oil dispersions at pine oil concentrations of up to about 25 wt. % which do not separate or cloud up after periods of storage and which have a very low content of volatile organic compounds.

DETAILED DESCRIPTION OF THE INVENTION

The detergents (surfactants) employed in formulating the cleaners of the present invention contain at least one anionic, non-ionic, cationic or amphoteric surfactant as well as soaps, and mixtures thereof. The anionic detergents employed are alkali metal salts, such as sodium or potassium, or ammonium or lower alkanolammonium salts, e.g., triethanolamine salts. The anionic detergent may be a sulfate, sulfonate, phosphate or phosphonate or salt of other suitable acid but usually will be a sulfate or sulfonate. The anionic detergents will include a lipophilic group, which will normally have from 10 to 18 carbon atoms, preferably in linear higher alkyl arrangement, but other lipophilic groups may be present instead, preferably including 12 to 16 carbon atoms, such as branched chain alkyl benzene. In some cases the anionic detergents may include poly-lower alkoxy groups, as in ethoxylated higher fatty alcohol sulfates, e.g., triethoxylated lauryl alcohol sulfate. Normally the number of ethoxy groups in such detergents will be in the range of 1 to 30, preferably 1 to 10. As examples of suitable anionic detergents there may be mentioned: higher fatty alcohol sulfonates, such as sodium tridecyl sulfonate; sodium linear alkyl benzene sulfonates, e.g., sodium linear do-or tridecylbenzene sulfonate; olefin sulfonates; and paraffin sulfonates. All of the anionic detergents will preferably be sodium salts but potassium, ammonium and triethanolammonium salts may also be used. Usually the detergent will preferably include a lipophilic alkyl moiety of 12 to 16 carbon atoms, often preferably of or averaging 12 to 13 carbon atoms.

Suitable nonionic detergents will normally be condensation products of lipophilic compounds or moieties and lower alkylene oxides or polyalkoxy moieties. Highly preferable lipophiles are higher fatty alcohols of 10 to 18 carbon atoms but alkyl phenols, such as octyl and nonyl phenols, may also be used. The alkylene oxide of preference is ethylene oxide and normally from 2 to 30 moles of ethylene oxide will be present per mole of lipophile. Suitable non-ionic detergents also include mono-, di-, and triesters of polyols with fatty acids, such as the triesters resulting from the reaction of ethoxylated glycerol with one or a mixture of fatty acids. Suitable such materials are marketed under the trade name LEVENOL®.

Suitable anionic soaps which may be used include the saponification products of one or a mixture of $C_{10}$–$C_{18}$ fatty acids with potassium or sodium hydroxide, as well as glyceride esters thereof. Suitable acids include tall oil, oleic acid, coconut oil, stearic acid, a vegetable or fish oil fatty acid, a tallow fatty acid or mixtures of these. The soaps may be formed in the composition in-situ by mixing the acid and an appropriate amount of caustic to neutralize at least about 35% of the acid groups.

Cationic surfactants which may be used include mono $C_8$–$C_{24}$ alkyl or alkenyl onium salts such as stearalkonium chloride or ditallow dimethyl ammonium chloride.

Amphoteric surfactants include alkyl betaines and sulfobetains such as cocoamidopropyl betaine.

Descriptions of many such surfactants are found in the text "Surface Active Agents and Detergents", Vol. II, pages 25–138, by Schwartz, Perry and Berch, published in 1958 by Interscience Publishers, Inc. Such compounds are also described in a 1973 publication by John W. McCutcheon, entitled "Detergents and Emulsifiers". Both such publications are hereby incorporated by reference.

In the more preferred embodiment of the invention, the surfactants used are anionic surfactants and mixtures of anionic surfactants such as dodecyl benzene sodium sulfonate, sodium lauryl sulfate or sulfonate, sodium lauryl ether sulfate or sulfonate (2–10 moles of ethylene oxide or propylene oxide) as well as fatty acid soaps and mixtures of two or more of these.

The total concentration of surfactant or mixed surfactant present in the composition (as active ingredient) may generally range from about 2 to about 25 wt. %, more preferably from about 3 to about 15 wt. %.

The pine oil component may be present in the composition at a level in the range of from about 5 to 25 wt. %, more preferably from about 10 to 20 wt. %. Suitable pine oils for use herein may be the products of the distillation of pine wood, cones and/or needles such as steam or destructively distilled pine oil, or synthetic pine oil such as made by partial oxidation of terpene hydrocarbons to terpene alcohols and sulfated pine oils.

The alkyl or alkaryl amide insect repellents, where present in the compositions of this invention, are well known materials having insect repellant properties. Neoalkanamides are particularly described in U.S. Pat. No. 5,006,562, the complete disclosure of which is incorporated herein by reference. They are generally prepared by reacting a $C_1$ to $C_4$ alkyl amine, e.g., methyl or ethyl amine with a neoalkanoyl chloride. These amides have the general formula:

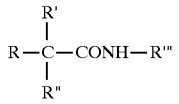

wherein R, R' and R" are alkyl groups, the sum of the carbon atom contents of which is in the range of 5 to 12, and R'" is an alkyl, preferably a lower alkyl group, more preferably of 1 to 4 carbon atoms.

To make the neoalkanamides, neoalkanoyl chloride reactant is slowly reacted with the appropriate primary amine, in ethyl ether, after which reaction the reaction mixture is washed with distilled water, dilute hydrochloric acid solution, dilute sodium hydroxide solution, and more distilled water, until it is neutral to pH paper. The ether is then removed by means of a steam bath, followed by employment of a vacuum evaporator. The reaction product obtained is water white to light amber in color and is essentially pure. In an alternative method, the neoalkanoic acid may be reacted directly with the lower alkylamine.

Neoalkanoic acids, such as neodecanoic acid, neoheptanoic acid and neopentanoic acid, are available from Exxon Chemical Americas, which synthesizes them by reacting a suitable branched alkene, such as a branched nonene feedstock, and carbon monoxide under high pressure at elevated temperature in the presence of aqueous acidic catalyst (Koch reaction). The general mechanism involved includes generation of carbonium ion, followed by complexation with carbon monoxide and the catalyst to form a "complex", which is subsequently hydrolyzed to generate free acid.

In neodecanoic acid, for example, the total number of carbon atoms in R, R' and R" is 8, 31% of the neodecanoic acid is of a structure wherein R' and R" are both methyl and R is hexyl, 67% is of a formula wherein R' is methyl, R" is alkyl of a carbon atoms content greater than that of methyl and less than that of R, and R is of a carbon atoms content less than that of hexyl and greater than that of R", and 2% is of the formula wherein R' and R" are both of a carbon atoms content greater than that of methyl and less than that of R, and R is of a carbon atoms content less than that of hexyl and greater than those of R" and R". Among other neoalkanoic acids that are available and useful to make the present amides may be mentioned others in the 7 to 16 carbon atoms content range, such as neoheptanoic, neononanoic, neodecanoic, neododecanoic, neotridecanoic and neotetradecanoic acids. In the various neoalkanoic acids mentioned, when R is alkyl of 5 or more carbon atoms, such alkyl is branched.

The acyl chloride starting materials for the reactions to produce the N-lower alkyl neoalkanamides may be made from the neoalkanoic acids and suitable chlorinating agents, such as phosphorus trichloride, and are available from PPG Industries, Inc.

The most preferred neoalkanamide for use in this invention is methyl neodecanamide (MNDA) because this species produces the most stable dispersions when used in compositions containing pine oil at relatively high levels of about 10 wt. % or more.

These insect repellents are generally present in the composition at insect repelling levels, generally in the range of from about 0.2 to about 15 wt. %, more preferably in the range of about 0.5 to 10 wt. % even more preferably in the range of about 1–5 wt. %, and most preferably at about 1.5 to 2.5 wt %.

The combination of solvents which are used in the invention tend to compatibilize the water insoluble pine oil and the alkamide insect repellent within the aqueous dispersion such that clear stable dispersions are formed which will not separate or cloud up after a period of standing. Also the solvents appear to act synergistically such that lesser amounts of the combination is required to achieve a stable dispersion than would be the case if each type of solvent were used alone as the sole solvent source. This phenomena allows for a significantly lower VOC content in the composition which is more environmentally preferable.

The first solvent component comprises at least one water soluble aliphatic alcohol containing from 1 to 5 carbon atoms, more preferably from 2 to 4 carbon atoms. Preferred alcohols include ethanol, propanol and isopropanol, with isopropanol being most preferred.

The second component of the solvent mix is at least one water soluble glycol mono $C_1$–$C_4$ alkyl ether having a solubility in water at 25° C. in excess of 10 g/100 g of water. Suitable such glycol ethers include an ethylene-, propylene-, diethylene- or dipropylene glycol of a $C_1$–$C_4$ mono alkyl ether. Specific examples include ethylene glycol monomethyl-, monoethyl- and monobutyl ethers, propylene glycol propyl ether, dipropylene glycol methyl ether, diethylene glycol monobutyl ether, and ethylene glycol monoethyl ether acetate.

These solvents may be mixed at a respective weight ratio of from about 1:2 to 2:1, more preferably at a ratio of 0.75:1 to 1.25:1 and most preferably at a ratio of 0.8:1 to 1:1 of alcohol and glycol respectively. A preferred solvent combination is isopropyl alcohol and diethylene glycol monobutyl ether. The mixed solvents are present in the composition at a level of from about 1 to less than about 7 wt. %, more preferably from about 2 to 5 wt. %, based on the total weight of the aqueous dispersion.

The compositions of the invention also preferably contain one or a mixture of well known sequesterants which are capable of complexing with cations (e.g., calcium or iron) present in the composition or in water which may be used to dilute the cleaning composition. Suitable sequesterants include ethylenediaminetetraacetic acid (EDTA) or sodium dihydroxyethylglycine, present in the composition at a level of from about 0.05 to 0.2 wt. %.

The composition may also include one or more of the conventional detergent builders such as the water soluble salts of polyphosphates, polycarboxylates, aminopolycarboxylates, polyphosphonates and sulfates. However, it is preferred not to use a builder salt in the cleaners of this invention since these tend to leave a residue on the cleaned surface, especially noticeable on hard surfaces, and may also contribute to destabilization of the clear aqueous dispersion.

Various other adjuvants may be present in the compositions of this invention to improve various characteristics of such products. Thus, for example, perfumes and colorants may be added for their aesthetic effects and soil anti-redeposition agents may be employed, such as sodium carboxymethyl cellulose. Among other adjuvants there may be mentioned fluorescent brighteners, pH adjusters or buffers, antistatic agents, antibacterial agents, fungicides, foaming agents, anti-foams, flow promoters, suspending agents, antioxidants, anti-gelling agents, soil release promoting agents, enzymes, emulsifiers and antioxidants.

The composition of the invention may be prepared by first mixing water, caustic, and fatty acid followed by anionic surfactant, solvents, insect repellent, perfume and pine oil using any suitable mixing device which provides good mixing, e.g., a high shear mixer. Adjuvants such as colorants or sequesterants are preferably added last.

The amount of water present in the composition may generally range from about 50 to 90 wt. %. Compositions containing lower amounts of water in this range and higher amounts of other active ingredients can be used as concentrates adapted to be diluted with additional water prior to storage and subsequent use.

As indicated above, the compositions of this invention are clear, stable aqueous dispersions which will not separate on standing and which are generally stable and do not cloud up at temperatures ranging from just below 0° C. up to about 53° C., which are temperature variations that may be encountered during shipping and prolonged storage.

The following examples are illustrative of the invention. As used in the examples, the following terms have the following meanings:

LAS—Sodium salt of a linear docecyl benzene sulfonate.

CFA—Coconut oil fatty acid.

IPA—Isopropyl alcohol.

DEGMBE—Diethylene glycol monobutyl ether.

VERSENE™—Sodium dihydroxyethylglycine (Na DHEG) (sequesterant).

MNDA—Methyl neodecanamide.

KOH—Potassium hydroxide.

EXAMPLES 1–10

A series of formulations mixed by the above procedure were evaluated for stability. These formulations are shown in Table 1. The formulations of Examples 1–3 are within the scope of this invention and those of Examples 4–10 are outside the scope of the invention. Examples 1–3 contain both the IPA and DEGMBE and produced stable dispersions at combined solvent levels of about 4 to 4.5 wt. %. Comparative Examples 4–10 contain only one of IPA or DEGMBE at levels ranging from about 2 to 4 wt. % and produced unstable dispersions. It is noted that a stable dispersion is produced in Examples 1 and 3 where the combined content of IPA and DEGMBE is 4.0 wt. %, whereas unstable dispersions are formed using IPA alone at 4.0 wt. % (Ex. 5 and 9) or DEGMBE alone at 4.0 wt. % (Ex. 7).

Formulations 1–3 also have been demonstrated to be effective to repel cockroaches from hard surfaces such as vinyl tile.

TABLE 1

| Wt. % Ingred. | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| Pine Oil | 10.0 | 20.0 | 10.0 | 10.0 | 10.0 | 10.0 | 10.0 | 10.0 | 10.0 | 10.0 |
| CFA | 5.0 | 9.6 | 5.0 | 5.0 | 5.0 | 5.0 | 5.0 | 5.0 | 5.0 | 5.0 |
| KOH | 3.0 | 5.8 | 3.0 | 3.0 | 3.0 | 3.0 | 3.0 | 3.0 | 3.0 | 3.0 |
| IPA | 2.0 | 2.0 | 2.5 | 2.5 | 4.0 | — | — | 2.5 | 4.0 | — |
| DEGMBE | 2.0 | 2.5 | 2.0 | — | — | 2.0 | 4.0 | — | — | 2.0 |
| MNDA | 2.0 | 2.0 | 2.0 | 2.0 | 2.0 | 2.0 | 2.0 | 2.0 | 2.0 | 2.0 |
| LAS | 1.0 | 1.0 | 1.0 | 0.5 | 0.5 | 0.5 | 0.5 | 1.0 | 1.0 | 1.0 |
| VERSENE ™ | 0.1 | 0.1 | 0.1 | 0.1 | 0.1 | 0.1 | 0.1 | 0.1 | 0.1 | 0.1 |
| WATER | --(TO 100)-- | | | | | | | | | |
| STABILITY | ST | ST | ST | UNS | UNS | UNS | UNS | UNS | UNS | UNS |

LEGEND:
ST - Stable dispersion, did not separate on standing.
UNS - Unstable dispersion, separated or clouded immediately or on standing up to 1 day.

What is claimed is:

1. A stable aqueous detergent composition comprising a homogeneous mixture of:

a) from about 5 to 25 wt % pine oil;

b) from about 3 to 15 wt % of one or a mixture of anionic surfactants which comprises a salt of a linear dodecyl benzene sulfonate;

c) isopropanol;

d) diethylene glycol monobutyl ether;

e) from about 1 to 5 wt % of neodecanamide; and f) water;

the relative proportion of said isopropanol and said diethylene glycol monobutyl ether being in the respective weight ration of 0.75:1 to 1.25:1 and the content of said isopropanol and said diethylene glycol monbutyl ether combined being at a level of from about 2 to 5 wt % of said composition.

2. A stable aqueous detergent composition comprising a homogeneous mixture of:

a) from about 5 to 25 wt % pine oil;

b) from about 3 to 15 wt % of a mixture of anionic surfactants comprising a sodium salt of a linear dodecyl benzene sulfonate and a coconut oil fatty acid;

c) isopropanol;

d) diethylene glycol monobutyl ether;

e) from about 1 to 5 wt % of neodecanamide; and f) water;

the relative proportion of said isopropanol and said diethylene glycol monobutyl ether being in the respective weight ratio of 0.75:1 to 1.25:1 and the content of said isopropanol and said diethylene glycol monbutyl ether combined being at a level of from about 2 to 5 wt % of said composition.

* * * * *